US008938955B2

(12) United States Patent
Kim et al.

(10) Patent No.: US 8,938,955 B2
(45) Date of Patent: Jan. 27, 2015

(54) EXHAUST MANIFOLD

(75) Inventors: Young Tae Kim, Seoul (KR); Kwang Hee Nam, Gyeonggi-do (KR); Chun Ho Baek, Gyeonggi-do (KR); Dong Kyu Lee, Gyeonggi-do (KR)

(73) Assignee: Wooshin Industrial Co., Ltd., Chungcheongnam-do (KR)

( * ) Notice: Subject to any disclaimer, the term of this patent is extended or adjusted under 35 U.S.C. 154(b) by 107 days.

(21) Appl. No.: 13/699,445

(22) PCT Filed: May 23, 2011

(86) PCT No.: PCT/KR2011/003770

§ 371 (c)(1),
(2), (4) Date: Nov. 21, 2012

(87) PCT Pub. No.: WO2011/149235

PCT Pub. Date: Dec. 1, 2011

(65) Prior Publication Data

US 2013/0067897 A1 Mar. 21, 2013

(30) Foreign Application Priority Data

May 25, 2010 (KR) ..... 10 2010 0048679

(51) Int. Cl.
*F01N 1/00* (2006.01)
*F01N 13/10* (2010.01)

(52) U.S. Cl.
CPC ..... *F01N 13/10* (2013.01); *F01N 2260/06* (2013.01); *F01N 13/107* (2013.01)
USPC ..... 60/323; 60/305; 60/315; 60/322

(58) Field of Classification Search
CPC ..... F01N 2340/04
USPC ..... 60/274, 305, 312, 313, 314, 320, 322, 60/323
See application file for complete search history.

(56) References Cited

U.S. PATENT DOCUMENTS

| | | | | |
|---|---|---|---|---|
| 5,816,045 | A * | 10/1998 | Blocker et al. | 60/323 |
| 5,881,553 | A * | 3/1999 | Steenackers et al. | 60/299 |
| 6,381,956 | B1 * | 5/2002 | Gilbertson | 60/312 |
| 6,725,655 | B2 * | 4/2004 | Yoshirawa et al. | 60/323 |
| 6,962,048 | B2 * | 11/2005 | Ashida et al. | 60/302 |
| 7,520,127 | B2 * | 4/2009 | Ashida et al. | 60/323 |
| 2004/0226291 | A1 * | 11/2004 | Diez et al. | 60/323 |

FOREIGN PATENT DOCUMENTS

| | | | |
|---|---|---|---|
| JP | 58-173718 | U | 11/1983 |
| JP | 60-050217 | A | 3/1985 |
| JP | 2008-031925 | A | 2/2008 |

* cited by examiner

*Primary Examiner* — Binh Q Tran
(74) *Attorney, Agent, or Firm* — Rabin & Berdo, P.C.

(57) ABSTRACT

An exhaust manifold includes: an inlet portion which collects exhaust gas discharged through a first to a fourth exhaust ports; an outlet portion discharging the exhaust gas; and a tube portion connecting the inlet and the outlet portions. The inlet portion comprises: a first inlet portion one end of which communicates with the first and the second exhaust ports; and a second inlet portion one end of which communicates with the third and the fourth exhaust ports. Since the inlet portion is provided as two considering the combustion sequence, the productability and the economic feasibility can be enhanced, and the surrounding space can be enlarged to enhance the workability, and a simple exterior appearance can be obtained, and interference between exhaust gases can be effectively prevented, and since the size of the exhaust manifold can be increased, an engine load can be reduced to improve the fuel mileage.

7 Claims, 2 Drawing Sheets

EXHAUST MANIFOLD

FIELD OF THE INVENTION

The present invention relates to an exhaust manifold for vehicles.

BACKGROUND ART

Generally, an engine of a vehicle combusts fuel mixed with air at an appropriate ratio to generate thermal energy and converts the thermal energy to mechanical energy.

Exhaust gas of high temperature and pressure is produced during the process of the combustion of an engine, and the exhaust gas is collected by an exhaust manifold and is then guided to an exhaust pipe, and harmful components of the exhaust gas may be removed while passing through a catalytic converter and noises are reduced while passing through a muffler.

The exhaust manifold includes an inlet which is formed at an upstream thereof to be connected to a combustion chamber and an outlet which is formed at a downstream thereof.

A conventional exhaust manifold is configured to have a plurality of inlets which are divided respectively for combustion chambers of an engine so as to prevent the deterioration of output performance due to the interference between gases exhausted from the combustion chambers after the combustion. Accordingly, gases exhausted from the respective combustion chamber of an engine flow respectively into a plurality of inlets and move in the respective tubes. Such tubes are unified before being exhausted, so the outlet is formed as one.

However, since the inlet is provided as the plurality, the interference between gases exhausted from different combustion chambers can be prevented, but since the inlet and the tube should be provided with the same number as the combustion chambers, there are problems in that the productability and the economic feasibility are deteriorated, and the possibility of fault may be increased due to the assembly of many parts, and the workability may be decreased due to the greater spatial occupation, and the exterior appearance may be poor.

DETAILED DESCRIPTION OF THE INVENTION

Technical Problem

The present invention has been made in an effort to provide an exhaust manifold in which the productability and the economic feasibility can be enhanced and a surrounding space can be secured to increase the workability and to have a simple appearance and at the same time to minimize the interference between exhaust gases and to enhance the efficiency of an engine.

Technical Solution

An exhaust manifold according to an embodiment of the present invention includes: an inlet portion which collects exhaust gas discharged through a first to a fourth exhaust ports after combustion of an engine; an outlet portion discharging the exhaust gas collected by the inlet portion; and a tube portion connecting the inlet portion and the outlet portion. The inlet portion comprises: a first inlet portion one end of which communicates with the first and the second exhaust ports; and a second inlet portion one end of which communicates with the third and the fourth exhaust ports.

The inlet portion may further include an inlet flange comprising a first through hole portion one side of which is connected to the first and the second exhaust ports and the other side of which is connected to one end of the first inlet portion, and a second through hole portion one side of which is connected to the third and the fourth exhaust ports and the other side of which is connected to one end of the second inlet portion.

The first through hole portion may be perforated as one in a size and a shape covering a part connected to the first and the second exhaust ports, and the second through hole portion may be perforated as one in a size and a shape covering a part connected to the third and the fourth exhaust ports.

One end of the first inlet portion may be perforated as one in a size and a shape covering a part connected to the first through hole portion, and one end of the second inlet portion may be perforated as one in a size and a shape covering a part connected to the second through hole portion.

The first through hole portion may include a first through hole one side of which is connected to the first exhaust port and a second through hole one side of which is connected to the second exhaust port, and the second through hole portion may include a third through hole one side of which is connected to the third exhaust port and a fourth through hole one side of which is connected to the fourth exhaust port.

One end of the first inlet portion may be perforated as one in a size and a shape covering a part connected to the first and the second through holes, and one end of the second inlet portion may be perforated as one in a size and a shape covering a part connected to the third and the fourth through holes.

The tube portion may include a first tube one end of which is connected to the other end of the first inlet portion, and a second tube one end of which is connected to the other end of the second inlet portion.

One end of the outlet portion may be branched so as to be respectively connected to the other ends of the first and the second tubes, and the other end thereof may be unified to form a single tube.

The first inlet portion and the second inlet portion may respectively include portions width of which becomes narrower when it goes toward the tube portion, and the first and the second tubes may have the same diameter along whole lengths thereof respectively.

The diameters of the first and the second tubes may have sizes corresponding to minimum widths of the first and the second inlet portions respectively.

An exhaust manifold according to an embodiment of the present invention includes a plurality of inlet portions for collecting exhaust gas exhausted from a plurality of exhaust manifolds after combustion of an engine, wherein one inlet portion corresponds to two or more exhaust ports which are not adjacent in terms of an engine combustion sequence but adjacent in terms of a disposition sequence.

Advantageous Effects

According to the present invention, since the inlet portion is provided as two in consideration of the combustion sequence of an engine, the productability and the economic feasibility can be enhanced, and the surrounding space can be enlarged to enhance the workability, and a simple exterior appearance can be obtained, and at the same time the interference between exhaust gases can be effectively prevented.

Furthermore, since the inlet portion is simplified into two, the spare space can be secured to increase the degree of freedom of design, thereby allowing the size of the exhaust port to be made greater than the port of the intake manifold of an engine, and accordingly exhaust gas can be easily exhausted to reduce an engine load (back pressure), thereby enhancing an engine output and improving the fuel mileage.

DETAILED DESCRIPTION OF THE EMBODIMENTS

Embodiments of the present invention will be described in detail hereinafter with reference to the accompanied drawings.

An exhaust manifold is a set of passages or tubes, and plays a role of passing exhaust gases exhausted from exhaust ports of a cylinder head of an engine. Generally, the exhaust manifold collects exhaust gases from respective exhaust ports and then unifies them into one flow.

The present invention relates to an exhaust manifold of a vehicle, and more particularly, to an exhaust manifold in which an inlet portion and a tube portion of the exhaust manifold are simplified in consideration of an ignition sequence of an engine, so the productability, the economic feasibility and the workability can be enhanced and the interference between the flows of the exhaust gas can be effectively prevented.

Figure 1:
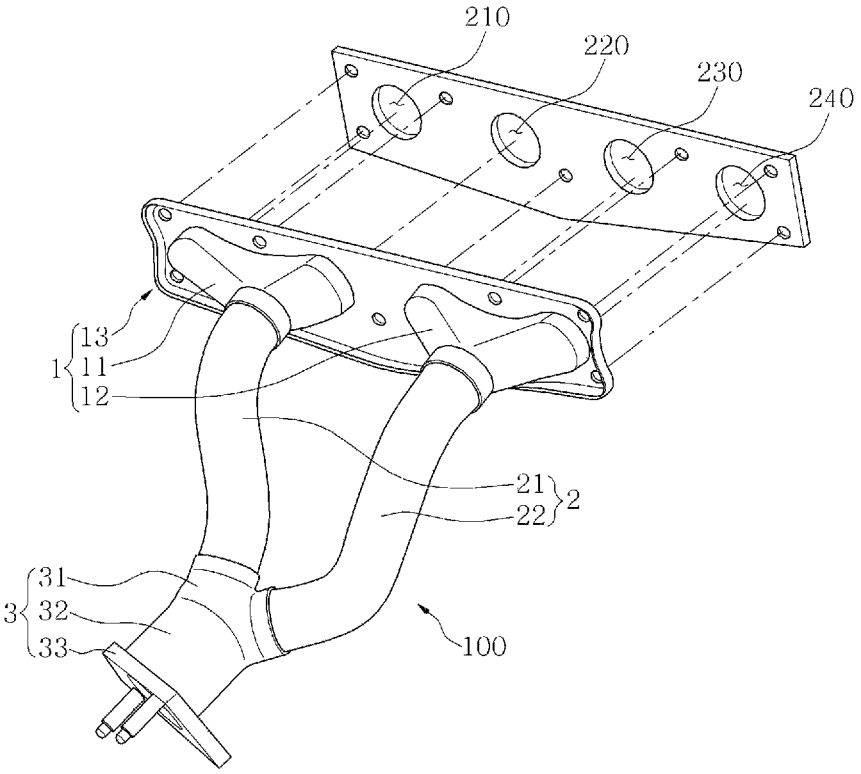
FIG. 1 is a perspective view of an exhaust manifold according to an embodiment of the present invention.
Figure 2:
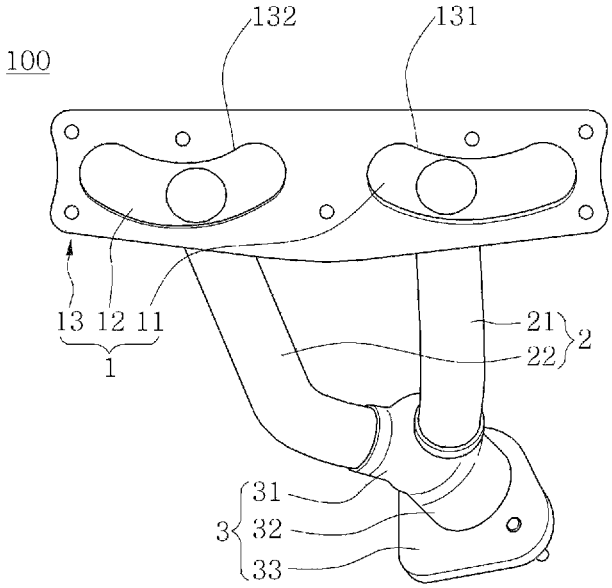
FIG. 2 is a perspective view of an exhaust manifold according to an embodiment of the present invention seen from another view point different from FIG. 1.

FIG. 1 is a perspective view of an exhaust manifold according to an embodiment of the present invention, and FIG. 2 is a perspective view of an exhaust manifold according to an embodiment of the present invention seen from another view point different from FIG. 1.

Referring to FIG. 1 and FIG. 2, an exhaust manifold 100 according to an embodiment of the present invention includes an inlet portion 1, an outlet portion 3 and a tube portion 2.

Exhaust gases exhausted from first to fourth exhaust ports 210, 220, 230 and 240 after the combustion are collected by the inlet portion 1. In addition, the exhaust gas collected by the inlet portion 1 is discharged through the outlet portion 3. Further, the tube portion 2 connects the inlet portion 1 and the outlet portion 3.

Here, the first to fourth exhaust ports 210, 220, 230 and 240 may be arranged in a line in an ascending or descending order. That is, in the first to fourth exhaust ports 210, 220, 230 and 240 and a first to fourth passages which will be explained later, "the first", "the second", "the third", and "the fourth" may indicate a disposition sequence. Exemplarily, as shown in FIG. 1, the first exhaust port 210, the second exhaust port 220, the third exhaust port 230 and the fourth exhaust port 240 may be sequentially disposed from the left to the right, and the description will be made hereinafter based on this sequence.

Further, referring to FIG. 1 and FIG. 2, the inlet portion 1 includes a first inlet portion 11 one end of which communicates with the first and the second exhaust ports 210 and 220, and a second inlet portion 12 one end of which communicates with the third and the fourth exhaust ports 230 and 240.

In a four-cylinder engine, different from a conventional art in which the inlet portion 1 are divided into four parts that are communicated respectively with the first to the fourth exhaust ports 210, 220, 230 and 240, in an embodiment of the present invention, the first and the second exhaust ports 210 and 220 are paired to communicate with one inlet portion 11, and the third and the fourth exhaust ports 230 and 240 are paired to communicated with one inlet portion 12.

The reason of this is to unify the respective inlet portions considering the ignition sequence of the engine and at the same time to reduce the interference between the exhaust gases. For example, in case of a four-cylinder engine in which exhaust of the gases is performed in the sequence of 1-3-2-4 (the first exhaust port-the third exhaust port-the second exhaust port-the fourth exhaust port), in an embodiment of the present invention the exhaust ports whose ignition sequences are not adjacent, i.e., sequential are paired, the two pairs are respectively allotted to the first inlet portion 11 and the second inlet portion 12, so in the paired exhausted ports the exhaust gas is not discharged sequentially so that the interference between the exhaust gases can be prevented.

Exemplarily, operation of the embodiment of the present invention depending on the ignition sequence of the cylinders of the engine will be explained with reference to FIG. 1.

First, an ignition occurs in a combustion chamber of a cylinder connected to the first exhaust port 210, and the exhaust gas generated by this combustion is exhausted through the first exhaust port 210. This exhaust gas is collected to the first inlet portion 11 which communicates with the first exhaust port 210. Subsequently, an ignition occurs in a combustion chamber of a cylinder connected to the third exhaust port 230, and the exhaust gas generated by this combustion is exhausted through the third exhaust port 230. This exhaust gas is collected to the second inlet portion 12 which communicates with the third exhaust port 230.

Subsequently, an ignition occurs in a combustion chamber of a cylinder connected to the second exhaust port 220, and the exhaust gas generated by this combustion is exhausted through the second exhaust port 220. This exhaust gas is collected to the first inlet portion 11 which communicates with the second exhaust port 220. Finally, an ignition occurs in a combustion chamber of a cylinder connected to the fourth exhaust port 240, and the exhaust gas generated by this combustion is exhausted through the fourth exhaust port 240. This exhaust gas is collected to the second inlet portion 12 which communicates with the fourth exhaust port 240.

As such, although the inlet portion 1 is reduced to two (11, 12) from the four of the prior art, the exhaust gas is alternately collected to the first inlet portion 11 and the second inlet portion 12 according to an ignition sequence of an engine, so the interference between the exhaust gas can be prevented. In addition, since the inlet portion 1 is reduced to two, the number of the required parts is reduced and the manufacturing cost is also decreased, and a space for a maintenance work around the exhaust manifold 100 can be enlarged. The exterior appearance is also simplified. Further, with regard to the performance, since the inlet portion 1 is simplified to two (11, 12), a space can be secured so that the degree of freedom of design is increased, so the size of the exhaust port can be formed greater than an intake port of an engine. Accordingly, the exhaust gas can be exhausted more easily, so the engine load can be reduced so that the output of the engine and the fuel mileage can be improved.

That is, according to an embodiment of the present invention, since the inlet portion 1 are formed as two (11, 12) in consideration of the ignition sequence of an engine, the productability and the economic feasibility can be enhanced and the surrounding space can be secured so that the workability can be improved and the simple appearance can be achieved, and at the same time the interference between the exhaust gas can be prevented and the size of the exhaust port can be enlarged, so the engine load can be reduced so as to enhance the fuel mileage.

Furthermore, referring to FIG. 1 and FIG. 2, the tube portion 2 may include a first tube 21 one end of which is connected to the other end of the first inlet portion 11, and a second tube 22 one end of which is connected to the other end of the second inlet portion 12. In case the inlet portion 1 is composed of the two parts, i.e., the first inlet portion 11 and the second inlet portion 12, the tubes 21 and 22 may be connected to the respective inlet portions 11 and 12.

However, the tube does not need to be necessarily connected to the first inlet portion 11 and the second inlet portion 12 respectively. Exemplarily, the tube may be formed as a single Y-shaped tube in which one end thereof is branched into two parts and the other is unified to a single tube. That is, the first inlet portion 11 and the second inlet portion 12 may be respectively connected to the branched ends.

However, considering that an object is to simplify the exhaust manifold while minimizing the interference of exhaust gases, it is preferable that the exhaust gas flowed into the first inlet portion 11 and the exhaust gas flowed into the second inlet portion 12 flow separately as much as possible, so it may be effective to be formed as the two separate tubes 21 and 22 until they are connected to the outlet portion 3.

In addition, referring to FIG. 1 and FIG. 2, one end 31 of the outlet portion 3 is branched so as to be respectively connected to the other ends of the first and the second tubes 21 and 22, and the other end 32 thereof may be unified so as to be formed as a single tube. In case that the respective tubes 21 and 22 are connected respectively to the inlet portions 11 and 12, in order to join the exhaust gas flows from the first tube 21 and the second tube 22, the one end 31 of the outlet portion 3 is formed to be branched into two parts, and the other end 32 thereof may be formed to be unified to a single part. Exemplarily, the outlet portion 3 may be a Y-shaped tube.

However, in case that a single Y-shaped tube is connected to the inlet portions 11 and 12, the end 31 of the outlet portion 3 does not need to be branched, so it may be formed as a simple linear pipe.

Meanwhile, as shown in FIG. 1, the first and the second inlet portions 11 and 12 respectively have a shape that width thereof becomes narrower when it goes toward the tube portion 2, and the first and the second tubes 21 and 22 of the tube portion 2 have the same diameter along their whole length respectively. Further, the diameters of the first and the second tubes 21 and 22 may have sizes corresponding to the minimum widths (i.e., the same widths of the ends of the side of the tube portion 2) of the first and the second inlet portions 11 and 12 respectively. According to these structures, the diameters of the first and the second tubes 21 and 22 may be minimized, so the manufacturing cost may be reduced and also a space for checking work around the exhaust manifold can be enlarged.

Further, referring to FIG. 1 and FIG. 2, the outlet portion 3 may further include an outlet flange 33. Exemplarily, an exhaust pipe may be connected to the outlet flange 33 so that the exhaust gas may flow to a catalytic converter, a muffler, or the like.

Meanwhile, as shown in FIG. 1 and FIG. 2, the inlet portion 1 may further include an inlet flange 13 which includes a first through hole portion 131 and a second through hole portion 132.

Here, referring FIG. 1 and FIG. 2 together, one side of the first through hole portion 131 may be connected to the first and the second exhaust ports 210 and 220, and the other side thereof may be connected to one end of the first inlet portion 11. In addition, one side of the second through hole portion 132 may be connected to the third and the fourth exhaust ports 230 and 240, and the other side thereof may be connected to the second inlet portion 12.

Further, the first through portion 131 is perforated in a single part which has a shape and a size covering the part connected to the first and the second exhaust ports 210 and 220, and the second through hole portion 132 is perforated in a single part which has a shape and a size covering the part connected to the third and the fourth exhaust ports 230 and 240.

A prior inlet flange may have through holes respectively for the exhaust ports 210, 220, 230, and 240. However, in an exhaust manifold 100 according to an embodiment of the present invention, the first exhaust port 210 and the second exhaust port 220 are unified so as to communicate with the single inlet portion 11, and the third exhaust port 230 and the fourth exhaust port 240 are unified so as to communicate with the other single inlet portion 12, so the inlet flange 13 may also have only two through holes 131 and 132.

Here, the first through hole portion 131 being perforated in a single part which has a shape and a size covering the part connected to the first and the second exhaust ports 210 and 220 may mean that the first through hole part 131 is perforated in a size totally including the part connected to the first exhaust port 210 and the part connected to the second exhaust port 220 on the inlet flange 13 and in a shape of not escaping from the inlet flange 13. The second through portion 132 being perforated in a single part which has a shape and a size covering the part connected to the third and the fourth exhaust ports 230 and 240 may be interpreted in the same way.

In addition, the first and the second through portions 131 and 132 may be formed in a shape of maintaining sealing while the exhaust gas is passing therethrough. This means that the first and the second through hole portions 131 and 132 is perforated to form sealing in addition to being perforated in the shape of not escaping from the inlet flange 13.

Exemplarily, considering only the first through hole portion 131 referring to FIG. 1 and FIG. 2, the first and the second exhaust ports 210 and 220 are connected to the first inlet portion 11 via the first through hole portion 131, and the exhaust gas passes therethrough. The first through hole portion 131 is required to be perforated in a shape of forming sealing so as to prevent that a gap between the first and the second exhaust ports 210 and 220 and the first through hole portion 131 or between the first through hole portion 131 and the first inlet portion 11 is formed to cause the exhaust gas to leak to the outside before reaching the catalytic converter or the like.

An end of the first inlet portion 11 may be formed as one in a size and a shape covering the part connected to the first through hole portion 131, and the second inlet portion 12 may be formed as one in a size and a shape covering the part connected to the second through hole portion 132.

That is, one ends of the first inlet portion 11 and the second inlet portion 12 are respectively perforated in one, as the first through hole portion 131 and the second through hole portion 132 described in the above, to be respectively connected to the first through hole portion 131 and the second through hole portion 132.

Here, one end of the first inlet portion 11 being perforated in a single part which has a size and a shape covering the part connected to the first through hole portion 131 may mean that one end of the first inlet portion 11 is perforated in a size covering the first through hole portion 131 totally and in a shape of not escaping from the inlet flange 13 when it is connected to the first through hole portion 131. One end of the second inlet portion 12 being perforated as one part in a size and a shape of covering the part connected to the second through hole portion 132 may be interpreted in the same meaning.

In addition, the first and the second inlet portions 11 and 12 may be formed in a shape of maintaining sealing while the exhaust gas is passing therethrough. This means that the ends of the first inlet portion 11 and the second inlet portion 12 are respectively perforated to form sealing in addition to being perforated in the shape of not escaping from the inlet flange 13.

Figure 3:
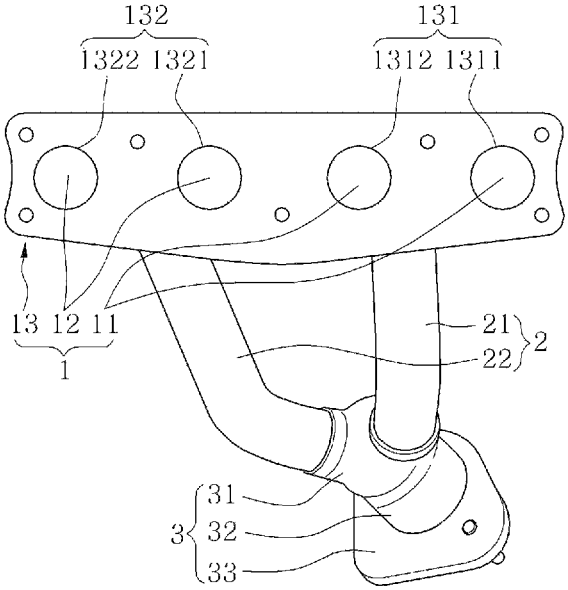
FIG. 3 is a perspective view of an exhaust manifold according to another embodiment of the present invention.

Meanwhile, FIG. 3 is a perspective view of an exhaust manifold according to another embodiment of the present invention which is seen from a view point different from FIG. 1. Explanations for the repeated parts having the same function as the above-described embodiment will be omitted, and the same reference numerals will be used for the same.

As shown in FIG. 3, the first through hole portion 131 includes a first through hole 1311 one side of which is connected to the first exhaust port 210 and a second through hole 1312 one side of which is connected to the second exhaust port 220, and the second through portion 132 includes a third through hole 1321 one side of which is connected to the third exhaust port 230 and a fourth through hole 1322 one side of which is connected to the fourth exhaust port 240.

That is, the inlet flange 13 of the exhaust manifold 100 in this embodiment may include four through holes 1311, 1312, 1321 and 1322 which correspond respectively to the four exhaust ports 210, 220, 230 and 240, similar to the prior art. In this case, the prior inlet flange can be used for the inlet flange 13 without modification.

Further, one end of the first inlet portion 11 may be perforated as one in a size and a shape covering the part connected to the first and the second through holes 1311 and 1312, and the second inlet portion 12 may be perforated as one in a size and a shape covering the part connected to the third and the fourth through holes 1321 and 1322.

Here, one end of the first inlet portion 11 being perforated in a single part which has a size and a shape covering the part connected to the first and the second through holes 1311 and 1312 may mean that one end of the first inlet portion 11 is perforated in a size covering the first through hole 1311 and the second through hole 1312 totally and in a shape of not escaping from the inlet flange 13. One end of the second inlet portion 12 being perforated as one part in a size and a shape covering the part connected to the third and the fourth through holes 1321 and 1322 may be interpreted in the same meaning.

In addition, the first and the second inlet portions 11 and 12 may be formed in a shape of maintaining sealing while the exhaust gas is passing therethrough. This means that the ends of the first inlet portion 11 and the second inlet portion 12 are respectively perforated to form sealing in addition to being perforated in the shape of not escaping from the inlet flange 13.

Meanwhile, not shown in the drawings, the exhaust manifold 100 according to an embodiment of the present invention includes a plurality of inlet portions which collect the exhaust gas discharged through a plurality of exhaust ports after the combustion of an engine, and one inlet portion corresponds to two or more exhaust ports which are not adjacent in terms of the combustion sequence but adjacent in terms of the disposition sequence. This extends the technical concept of the present invention that the structure of the inlet portion is simplified in consideration of the combustion sequence of an engine to minimize the interference between the exhaust gas and at the same time to enhance the productability, the economic feasibility, the exterior appearance, and the like, not limited to a four-cylinder engine.

Exemplarily, the case that an inline six-cylinder engine which has exhaust ports disposed in the sequence of 1-2-3-4-5-6 (the first to the sixth exhaust ports) has the ignition sequence of 1-5-3-6-2-4j will be described.

As two or more exhaust ports which are not adjacent in terms of the combustion sequence but adjacent in terms of the disposition sequence, the first and the second exhaust ports have the first and the fifth orders in terms of the combustion sequence so as to be not adjacent in terms of the combustion sequence but are adjacent in terms of the disposition sequence, and the third and the fourth exhaust ports (third and sixth orders in terms of the combustion sequence) and the fifth and the sixth exhaust ports (second and fourth orders in terms of the combustion sequence) are the same. Accordingly, it is configured such that one inlet portion corresponds to the first and the second exhaust ports. That is, it may also be configured that the exhaust gas exhausted from the first and the second exhaust ports is collected by the one inlet portion. In addition, it is configured such that one inlet portion corresponds to the third and the fourth exhaust ports and one inlet portion also corresponds to the fifth and the sixth exhaust ports.

Alternatively, the first to the third exhaust ports have the first, the fifth and the third orders in the combustion sequence so as to be not adjacent, but are adjacent in terms of the disposition sequence. In addition, the fourth to the sixth exhaust ports have the sixth, the second and the fourth orders in the combustion sequence so as to be not adjacent, but are adjacent in terms of the disposition sequence. In the above-described case one inlet portion corresponds to the two exhaust ports, but in this case one inlet portion corresponds to the three exhaust ports. That is, this means that exhaust gas discharged from the first to the third exhaust ports is configured to be collected by one inlet portion, and exhaust gas discharged from the fourth to the sixth exhaust ports is also configured to be collected by the other one inlet portion.

On the other hand, the second exhaust port and the fourth exhaust port have the fifth order and the sixth order in the combustion sequence so as to be adjacent in terms of the combustion order, so the first to the fourth exhaust ports cannot correspond to the one inlet portion.

Furthermore, the present invention may also be applied to an inline five-cylinder engine, a V-6 engine, a V-8 engine, or the like.

As such, according to the present invention, since the inlet portion is provided in a minimum number in consideration of a combustion sequence of an engine, the productability and the economic feasibility can be improved, and a space around the exhaust manifold can be enlarged so as to enhance the workability and a simple appearance can be obtained, and at the same time the interference between the exhaust gases can be effectively prevented and the engine output can be increased so as to enhance the fuel mileage.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

INDUSTRIAL APPLICABILITY

The present invention relates to an exhaust manifold for vehicles which can be able to be applied to vehicles, so the present invention has an industrial applicability.

The invention claimed is:

1. An exhaust manifold comprising:

an inlet portion that collects exhaust gas discharged through a first exhaust port, a second exhaust port, a third exhaust port, and a fourth exhaust port after combustion of an engine;

an outlet portion discharging the exhaust gas collected by the inlet portion; and a tube portion connecting the inlet portion and the outlet portion;

wherein the inlet portion includes:

a first inlet portion having a first end that communicates respectively with the first and the second exhaust ports; and a second inlet portion having a first end that communicates respectively with the third and the fourth exhaust ports, wherein the first and the second exhaust ports are not adjacent in an engine combustion sequence but are adjacent in a disposition sequence, and the third and the fourth exhaust ports are not adjacent in an engine combustion sequence but are adjacent in a disposition sequence;

wherein the tube portion includes a first tube having an end that is connected to a second end of the first inlet portion, and a second tube having an end that is connected to a second end of the second inlet portion;

wherein the first inlet portion and the second inlet portion respectively include portions having a width that becomes narrower in a direction going toward the tube portion, and the first and the second tubes have the same diameter along whole lengths thereof respectively; and wherein the diameters of the first and the second tubes have sizes corresponding to minimum widths of the first and the second inlet portions respectively.

2. The exhaust manifold of claim 1, wherein the inlet portion further includes an inlet flange including a first through hole portion having a first side that is connected to the first and the second exhaust ports and a second side that is connected to the first end of the first inlet portion, and a second through hole portion having a first side that is connected to the third and the fourth exhaust ports and a second side that is connected to the first end of the second inlet portion.

3. The exhaust manifold of claim 2, wherein the first through hole portion is perforated as one in a size and a shape covering a part connected to the first and the second exhaust ports, and the second through hole portion is perforated as one in a size and a shape covering a part connected to the third and the fourth exhaust ports.

4. The exhaust manifold of claim 3, wherein the first end of the first inlet portion is perforated as one in a size and a shape covering a part connected to the first through hole portion, and the first end of the second inlet portion is perforated as one in a size and a shape covering a part connected to the second through hole portion.

5. The exhaust manifold of claim 2, wherein the first through hole portion includes a first through hole having a side that is connected to the first exhaust port and a second through hole having a side that is connected to the second exhaust port, and the second through hole portion includes a third through hole having a side that is connected to the third exhaust port and a fourth through hole having a side that is connected to the fourth exhaust port.

6. The exhaust manifold of claim 5, wherein the first end of the first inlet portion is perforated as one in a size and a shape covering a part connected to the first and the second through holes, and the first end of the second inlet portion is perforated as one in a size and a shape covering a part connected to the third and the fourth through holes.

7. The exhaust manifold of claim 1, wherein an end of the outlet portion is branched so as to be respectively connected to the other ends of the first and the second tubes, and the other end thereof is unified to form a single tube.

* * * * *